US010037010B2

(12) United States Patent
Legeret et al.

(10) Patent No.: US 10,037,010 B2
(45) Date of Patent: Jul. 31, 2018

(54) TIMEPIECE COMPRISING A DEVICE FOR SWITCHING A TIMEKEEPING MECHANISM

(71) Applicant: Montres Breguet S.A., L'Abbaye (CH)

(72) Inventors: Benoit Legeret, Ecublens (CH); Benoit Junod, Peillonnex (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/614,884

(22) Filed: Jun. 6, 2017

(65) Prior Publication Data

US 2018/0004167 A1 Jan. 4, 2018

(30) Foreign Application Priority Data

Jul. 1, 2016 (EP) ..... 16177617

(51) Int. Cl.
*G04F 7/08* (2006.01)
*G04B 11/00* (2006.01)

(52) U.S. Cl.
CPC ..... *G04F 7/0842* (2013.01); *G04B 11/005* (2013.01); *G04F 7/0814* (2013.01); *G04F 7/0847* (2013.01)

(58) Field of Classification Search
CPC ..... G04B 11/005; G04F 7/08; G04F 7/0814; G04F 7/0842; G04F 7/0847; G04F 7/0857
See application file for complete search history.

(56) References Cited

U.S. PATENT DOCUMENTS 3,168,690 A 2/1965 Lavet et al.
3,462,942 A 8/1969 Meitinger et al.
8,179,744 B2 * 5/2012 Laucella ..... G04B 19/02 368/110
2013/0148476 A1 6/2013 Mertenat
2017/0176937 A1 * 6/2017 Legeret ..... G04B 13/026
2018/0004165 A1 * 1/2018 Sarchi ..... G04C 13/0409

FOREIGN PATENT DOCUMENTS

EP 2 602 675 A1 6/2013
FR 1 090 564 3/1955
FR 1 276 734 A 11/1961

OTHER PUBLICATIONS

European Search Report dated Jan. 3, 2017 in European application 16177617.4, filed on Jul. 1, 2016 (with English Translation of Categories Cited Documents).

* cited by examiner

*Primary Examiner* — Vit W Miska
(74) *Attorney, Agent, or Firm* — Oblon, McClelland, Maier & Neudstadt, L.L.P.

(57) ABSTRACT

The timepiece comprises a timekeeping mechanism and a switching device arranged to switch this timekeeping mechanism between two states. The switching device comprises a movable switching organ and a rotary control organ arranged to be stepwise driven in order to successively occupy a plurality of distinct angular positions about its axis of rotation. The movable switching organ and the rotary control organ respectively support a first magnetic structure and a second magnetic structure arranged so that, in a first angular position of the rotary control organ, a first magnetic force acts on the switching organ in a given direction, and so that, in a second angular position of the rotary control organ, a second magnetic force acts on the switching organ in the opposite direction.

10 Claims, 7 Drawing Sheets

TIMEPIECE COMPRISING A DEVICE FOR SWITCHING A TIMEKEEPING MECHANISM

This application claims priority from European Patent Application No. 16177617.4 filed on Jul. 1, 2016; the entire disclosure of which is incorporated herein by reference.

FIELD OF THE INVENTION

The present invention relates to a device for switching a timekeeping mechanism between two operating states.

More specifically, the present invention relates to a timepiece comprising, on the one hand, a timekeeping mechanism able to switch between a first determined state and a second determined state and, on the other hand, a switching device arranged to switch the timekeeping mechanism between its first and second states on command. This switching device comprises a movable switching organ and a rotary control organ, which is arranged to be stepwise driven in a given direction of rotation, in order to successively occupy a plurality of angular positions about an axis of rotation of said control organ. The switching device is arranged so that a stepwise rotation of the rotary control organ causes a reciprocating movement of the movable switching organ, substantially in a plane perpendicular to said axis of rotation, so that at least one part of this movable switching organ moves between two radial positions, in which the timekeeping mechanism is respectively in its first state and its second state.

PRIOR ART

A significant number of timepieces are already known that correspond to the field of the invention. In particular, the document EP 2602675 discloses a timekeeping movement that comprises a chronograph mechanism with a column wheel, said wheel forming a rotary control organ of the chronograph mechanism that has two operating states, namely "on" and "off". The timekeeping movement disclosed in this document of the prior art therefore comprises a column wheel and a clutch rocker arranged to cooperate with the column wheel in order to start or stop the chronograph mechanism. The column wheel is rotated stepwise in a single given direction of rotation on command, while the clutch rocker undergoes a reciprocating movement between two determined radial positions, in which the chronograph mechanism is respectively in the two aforementioned operating states.

More generally, whether watches-chronographs or other timepieces are involved, the known switching devices generally comprise a rotary control organ made up of a cam or a column wheel and a movable switching organ in the form of a cam follower of one type or another and, more specifically, made up of a rocker or a lever. A disadvantage of such switching devices is that in principle they all require the use of pre-stressed springs in order to return and hold the movable switching organ against the cam or the column wheel. Timekeeping springs are space consuming and delicate. They experience wear, which means that they progressively become less efficient. Furthermore, this ageing is significantly accelerated by the shocks that the timepiece can undergo. Moreover, by always returning the movable switching organ so that it is in abutment against the cam, the springs accelerate the wear of these two components. Finally, since timekeeping springs are small they are quite sensitive to any tolerances, which constitutes an additional problem.

BRIEF DISCLOSURE OF THE INVENTION

An object of the present invention is to overcome the aforementioned disadvantages of the prior art. The invention achieves this object by providing a timepiece according to appended claim 1.

According to the invention, the switching device comprises a movable switching organ and a rotary control organ respectively supporting a first magnetic structure and a second magnetic structure arranged in order to have a mutual magnetic interaction that allows the timekeeping mechanism to be switched between a first state and a second state on command. One of the first and second magnetic structures comprises at least one first magnetic pole and the other of the two magnetic structures comprises at least one second magnetic pole and a third magnetic pole with opposite polarities which are able to successively interact with the first magnetic pole. The first and second magnetic structures are arranged so that, in a first angular position of the rotary control organ, a first magnetic force, which is generated by a magnetic interaction between the first and second magnetic poles, acts on the switching organ in order to transfer said organ to one of its two stable radial positions and so that, in a second angular position of the rotary control organ, a second magnetic force, which is generated by a magnetic interaction between the first and third magnetic poles and is thus in the opposite direction to the first magnetic force, acts on the switching organ in order to return said organ to the other of its two stable radial positions.

It will be noted that, particularly in the case of a rocker pivoting about an axis parallel to the axis of rotation of the rotary control organ, the two stable radial positions more specifically relate to an end part of the switching organ. Within the context of a sliding switching organ, the entire organ undergoes a translation movement in a plane substantially perpendicular to said axis of rotation between two stable radial positions of its centre of mass.

It will be understood that, by virtue of these features, a spring does not need to be provided in order to continuously return the switching organ to one of the two stable radial positions. Therefore, this results in a reduction in the mechanical stresses and a mechanical energy saving. Such a magnetic system has the advantage of being a contactless system capable of alternately exerting two forces on the switching organ in opposite directions.

BRIEF DESCRIPTION OF THE DRAWINGS

Further features and advantages of the present invention will become apparent upon reading the following description, which is provided solely by way of non-limiting examples, and with reference to the accompanying drawings, in which:

FIGS. 1 and 2 are plan top views of a first embodiment of the invention, which is made up of a first particular striking-work stop device, with FIG. 1 showing this device in the disengaged position, while FIG. 2 shows it in its engaged position, in which it locks the striking-work;

DETAILED DESCRIPTION OF EMBODIMENTS

Accompanying FIGS. 1 to 5 show a first embodiment of the invention that is made up of a timepiece comprising a striking-work mechanism that can switch between a first state, in which the striking-work is activated, and a second state, in which the striking-work is stopped, and further comprising a striking-work stop device provided to switch the striking-work mechanism between the activated state and the stopped state. Thus, this device defines a switch.

Figure 1:
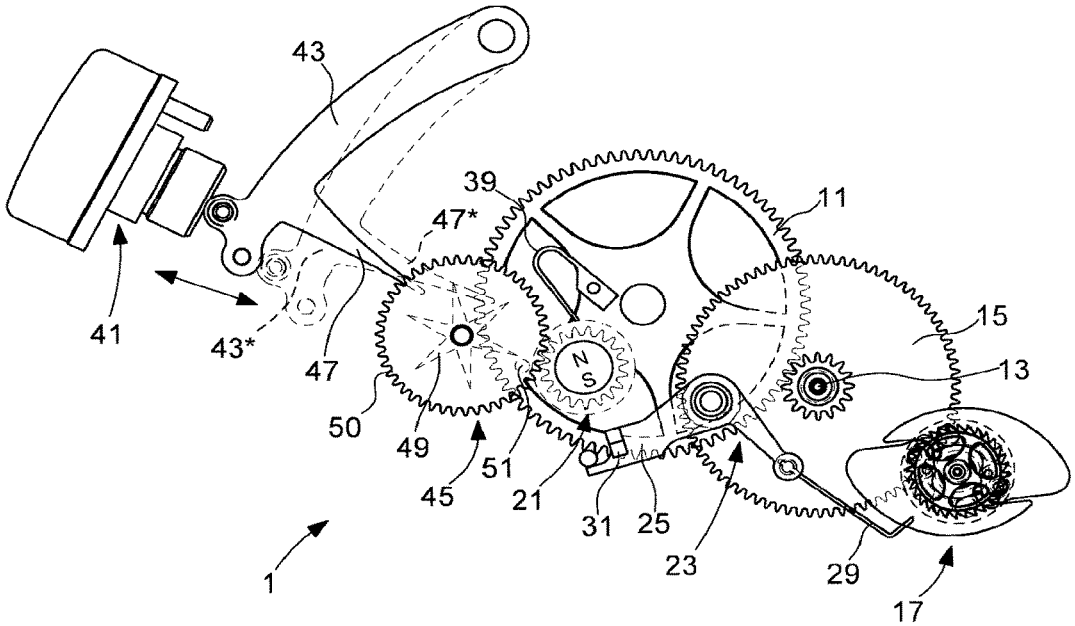
Figure 2:
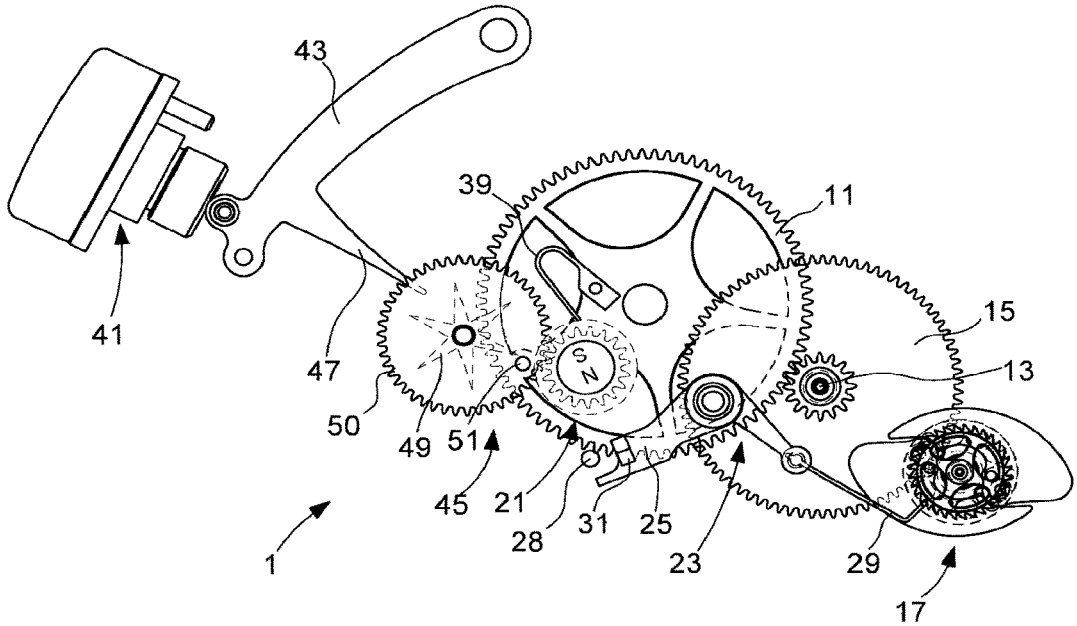

FIGS. 1 to 5 are partial views that do not show the timepiece in its entirety, but only show the constituent parts of its striking-work stop device and the small number of elements of the striking-work mechanism that directly interact with the striking-work stop device. FIGS. 1 and 2 are plan top views that show the striking-work stop device in its disengaged position and in its engaged position, respectively. By now considering these Fig. in further detail, three discs firstly can be seen that form part of the train of the striking-work mechanism. This involves a first disc formed by a wheel 11, a second disc formed by a wheel 15 integral with a pinion 13 and, finally, a third disc that is made up of a speed regulator, general reference numeral 17. FIGS. 1 and 2 show that the wheel 11 meshes with the pinion 13 in order to drive the second disc, and that the wheel 15 of the second disc meshes with a peripheral toothing (not referenced) of the regulator 17.

It is known that striking-work timepieces generally comprise a striking-work train associated with an energy source made up of a barrel, in which a drive spring, called barrel spring, is wound. If the barrel were simply connected to the striking-work, the progressive letting down of the spring would be expressed by the slowing down of the rhythm of the melody as it is executed. For this reason, this phenomenon is usually corrected by integrating a train regulator, which controls the striking-work. Neither the barrel nor the striking-work mechanism per se are shown in the Fig. However, it will be understood that the barrel is arranged to drive the striking-work train by means of the wheel 11 and that the striking-work per se is arranged downstream of the regulator 17 in order to be driven thereby.

Still with reference to the same Fig., a switching device (general reference numeral 1) also can be seen that comprises a rotary control organ 21 and a movable switching organ 23. The switching organ 23 comprises a rocker 25 pivotally mounted about a pivot axis. The rocker 25 comprises two arms extending from the pivot axis. A first arm of the rocker supports a hook 29 at its end and the second arm supports a bipolar magnet 31, the magnetisation direction of which is substantially parallel to the pivot plane of the rocker 25. The switching device further comprises a stop 28 arranged to cooperate with the second arm of the rocker in order to limit the stroke thereof.

Figure 3A:
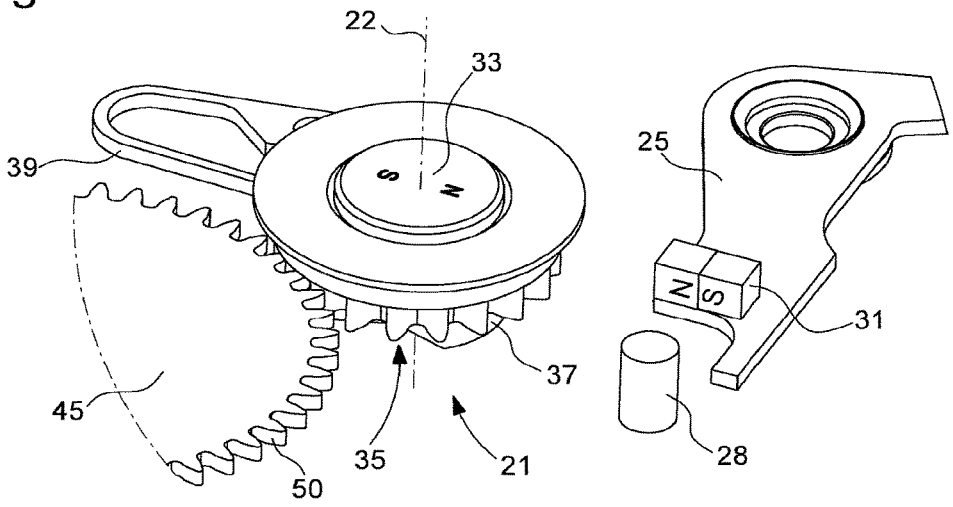
FIG. 3A is a partial perspective view of the striking-work stop device of FIGS. 1 and 2 showing the switching device in a configuration corresponding to the engaged position shown in FIG. 2.
Figure 3B:
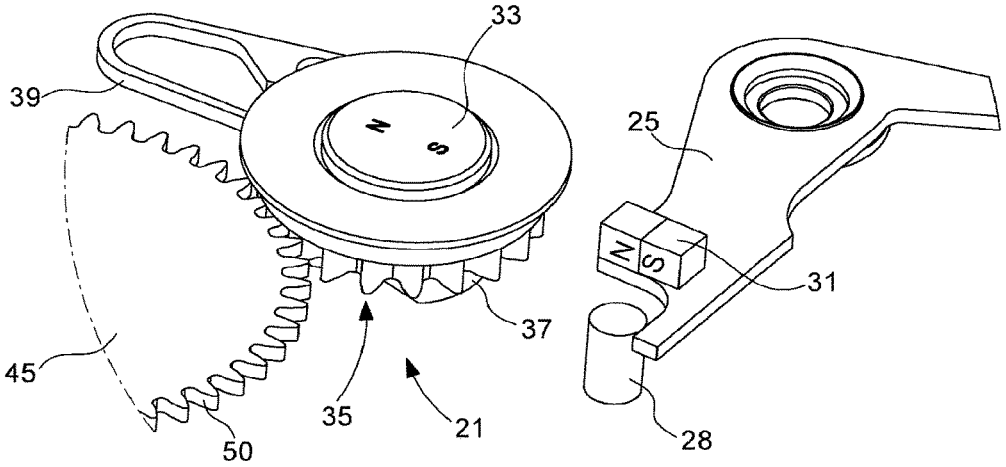
FIG. 3B is a partial perspective view of the striking-work stop device of FIGS. 1 and 2 showing the switching device in a configuration corresponding to the disengaged position shown in FIG. 1.
Figure 4:
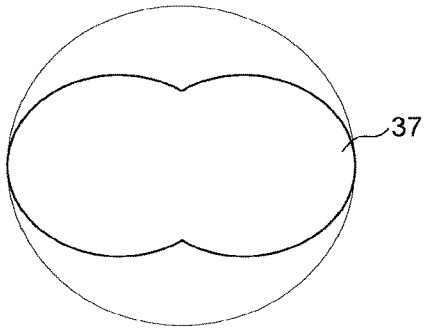
FIG. 4 is a schematic plan view of a bistable cam integral with the control organ of the first embodiment.

Reference will now be made to FIGS. 3A and 3B, which show the rotary control organ 21 in further detail. The control organ of the embodiment shown is pivotally mounted about an axis of rotation 22. This organ comprises a bipolar magnet 33, the magnetisation direction of which is perpendicular to the axis of rotation 22 of the control organ, and which is substantially centred on this axis of rotation. The rotary control organ further comprises a coaxial toothing 35 and a bistable cam 37, which can be in the shape shown in FIG. 4, for example. The figure-of-eight shaped bistable cam is also arranged to cooperate with a jumper spring 39. According to the invention, the rotary control organ 21 is arranged to be stepwise driven in a given direction of rotation in order to successively occupy a plurality of distinct angular positions about its axis of rotation. It will be understood that, in this example, the control organ 21 is designed to occupy exactly two distinct stable positions, which are spaced apart from each other by an angular step of 180°. The figure-of-eight shaped cam 37 and the jumper spring 39 are arranged so that one of the two poles of the magnet 33 is always located substantially opposite the magnet 31 when the rotary control organ 21 is in either of its two stable positions.

The switching device 1 shown in FIGS. 1 and 2 further comprises a push-piece activation mechanism. This mechanism comprises a push-piece 41, a control lever 43 and an intermediate disc 45. The control lever 43 has a beak 47 that is designed to cooperate with a starwheel 49 of the intermediate disc 45. The intermediate disc further comprises a concentric toothing 50 that meshes with the toothing 35 of the rotary control organ. In the example shown, the starwheel 49 comprises six branches. Therefore, it will be understood that the gear ratio between the toothing 50 and the toothing 35 is three in this example.

According to the invention, the switching device is arranged so that a stepwise rotation of the rotary control organ 21 causes a reciprocating movement of the movable switching organ 23 substantially in a plane perpendicular to the axis of rotation 22 of the control organ, between a first stable radial position and a second stable radial position. FIG. 1 shows the rotary control organ 21 in a first stable angular position, in which the south pole of the magnet 33 is opposite the north pole of the magnet 31. In these conditions, the magnet 31 of the switching organ 23 is drawn towards the control organ, so that the switching organ is immobilised in abutment against the stop 28, the movable switching organ then being in its first stable radial position, in which the hook 29 is disengaged from the regulator 17, so that said regulator is free to rotate. In these conditions, when a timepiece user activates the push-piece 41, said push-piece pushes the control lever 43, which pivots about its axis (not referenced) in order to move to the position 43*, which is shown by the broken lines in FIG. 1. During the pivoting movement of the lever 43, the beak 47 (47*) of the lever advances and pushes a branch of the starwheel 49, so that the intermediate disc 45 pivots by approximately a sixth of a rotation. By pivoting, the toothing 50 of the intermediate disc drives the control organ 21, which then completes a step of 180°, so that the north pole of the magnet 33 ultimately occupies the position facing the north pole of the magnet 31, as shown in FIG. 3B. The control organ thus moves to its second stable angular position. It is to be noted that it is the interaction between the bistable cam 37 and the jumper spring 39 that ensures that the length of the steps completed by the rotary control organ 21 is precisely 180°.

In the configuration of FIG. 3B, the magnetic force generated by the interaction between the magnets 31 and 33 pushes the magnet 31 so that the rocker 25 pivots and moves away from the stop 28. This pivoting movement causes the hook 29 to be lowered against an external toothing of the regulator 17. When the timepiece user subsequently releases the pressure on the push-piece 41, the lever 43 and the push-piece are both returned to their rest position by springs, not shown. From this point, the switching device is in the configuration shown in FIG. 2, where the switching organ 23 is now in its second radial position, in which the hook 29 is engaged in an external toothing of the regulator 17, so that said regulator is immobilised and the whole of the striking-work train is locked.

According to the first three embodiments of the invention that are the object of the present description, the switching device 1 is also adapted to automatically switch the striking-work mechanism, in order to act as a striking-work duration limiter. This second operating mode of the switching device 1 will now be described with reference to FIGS. 5A, 5B and 5C. As shown in these figures, the plate of the wheel 11 supports a pin 51 arranged on the periphery close to the toothing. It will be understood that the pin 51 covers a circular path upon each rotation of the wheel 11. Furthermore, the starwheel 49 of the intermediate disc 45 is placed on the path of the pin. As has been seen, the wheel 11 forms part of the striking-work train, which is a multiplier train. These figures show that the gear ratio is fairly high. In these conditions, when the striking-work is activated, the wheel 11 rotates relatively slowly.

Figure 5A:
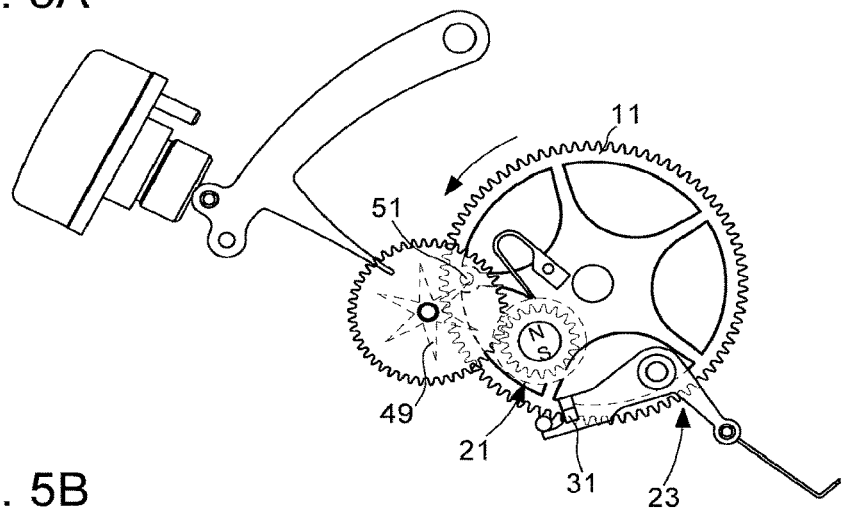
FIGS. 5A, 5B and 5C are plan top views similar to those of FIGS. 1 and 2, and which correspond to three successive instants showing the transition accompanying the automatic stopping of the striking-work.
Figure 5B:
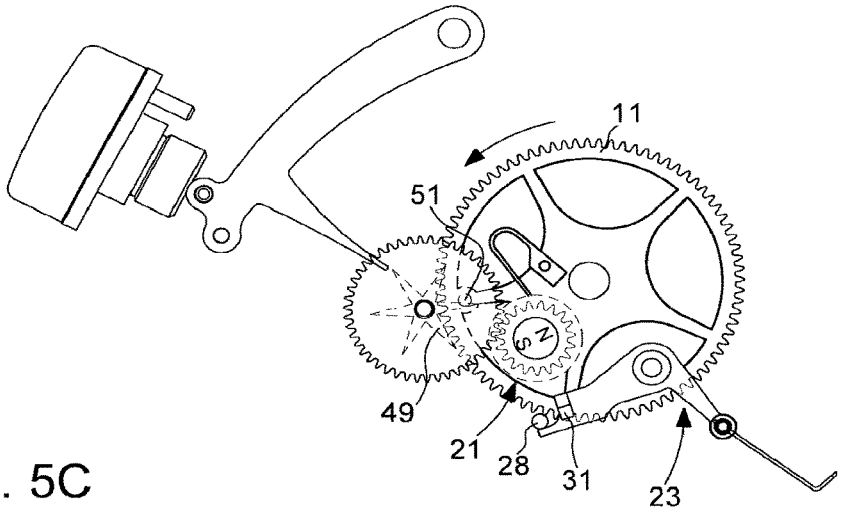
Figure 5C:
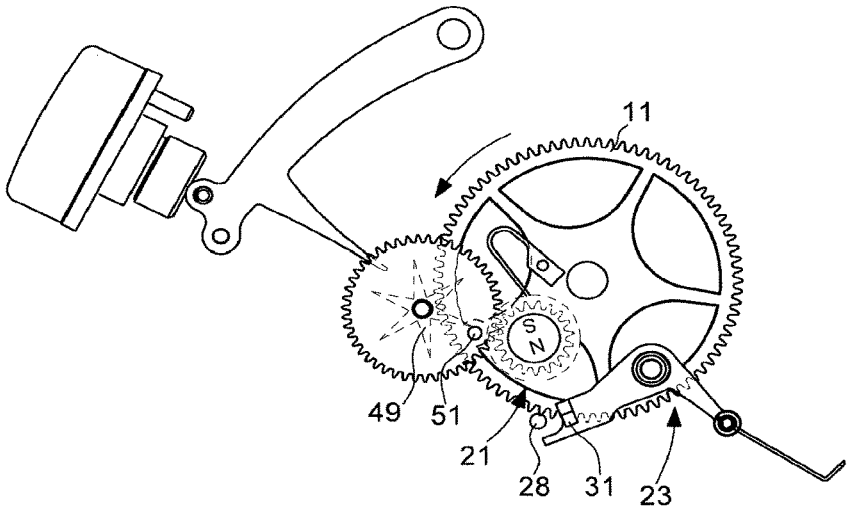

Seen from above, as shown in FIGS. 1, 2, 5A, 5B and 5C, the wheel 11 rotates in the anti-clockwise direction when the striking-work operates. FIG. 5A shows the switching device when the pin 51 comes into abutment against a branch of the starwheel 49. The pin 51 then continues its path by pushing the branch of the starwheel ahead of itself. In FIG. 5B, the forwards movement of the pin has caused the starwheel 49 to pivot by approximately $1/12^{th}$ of a rotation. In FIG. 5C, the pin has moved beyond the starwheel by completely pushing the branch that extended through its path. The starwheel 49 has then pivoted by a sixth of a rotation, thus causing the rotary control organ 21 to advance by a step. The effect of the rotary control organ completing successive steps is to alternately switch the striking-work mechanism between its two radial positions. In this case, the switching stops the striking-work and at the same time immobilises the train of the striking-work mechanism. The wheel 11 is therefore stopped in the position that it occupies in FIG. 5C. Therefore, it can be understood that the striking-work is automatically interrupted after a duration that approximately corresponds to the time needed for the wheel 11 to complete one revolution after an initial triggering of the striking-work via the push-piece 41.

Figure 6:
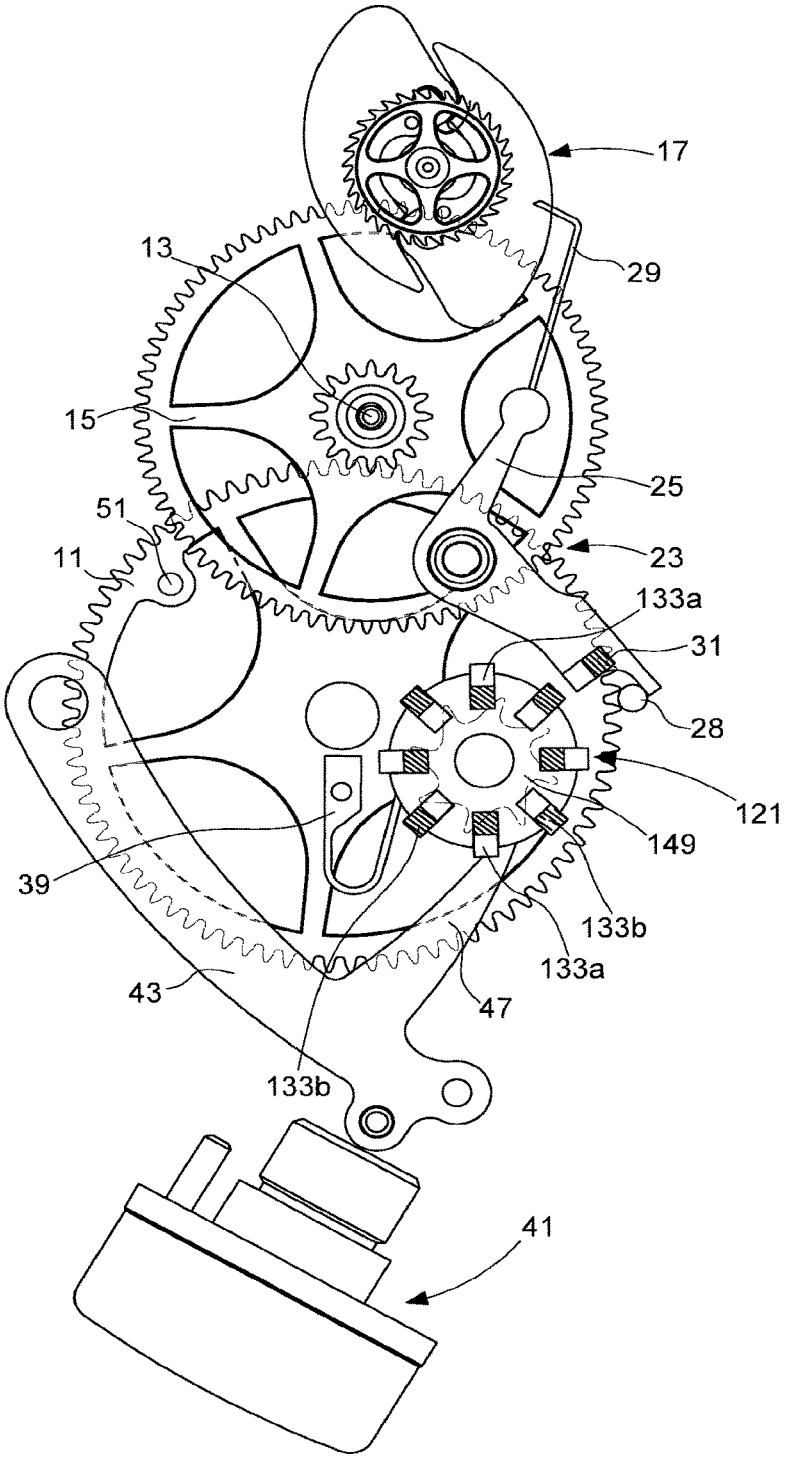
FIG. 6 is a plan top view of a second embodiment of the invention that is made up of a second particular striking-work stop device.

FIG. 6 is a plan top view of a second embodiment of the invention, which, like the first embodiment, is in the form of a striking-work stop device. This second model of a striking-work stop device shares several features with the first striking-work stop device described above. For the sake of readability, the elements of the second striking-work stop device that have already been described with reference to the first striking-work stop device are denoted using the same reference numerals in FIG. 6.

Comparing FIG. 6 to FIG. 1 shows that the basic difference between the first and the second embodiment relates to the rotary control organ, which in FIG. 6 is generally referenced 121. This rotary control organ is arranged to complete steps that each correspond to pivoting by an angle $\pi/N$, with $N>1$, so that the rotary control organ and the magnetic structure that it supports are caused to successively occupy 2N distinct angular positions about their axis of rotation. In the example shown, N=4. The control organ 121 is in the general shape of a disc pivoted at its centre about an axis of rotation (not referenced). The disc supports 2N bipolar magnets (each referenced 133*a* or 133*b*), that is eight magnets, which are evenly distributed around the periphery of the disc and the magnetisation direction of which is radially oriented relative to the axis of rotation of the control organ. The north pole of four magnets, reference numeral 133*a*, is turned outwards, and the south pole of the other four magnets (reference numeral 133*b*) is turned outwards. The rotary control organ 121 further comprises a starwheel 149 with 2N branches, which starwheel is mounted under the disc supporting the magnets. According to the invention, the rotary control organ 121 is arranged to be stepwise driven in a given direction of rotation in order to successively occupy a plurality of distinct angular positions about its axis of rotation. In this example, the control organ 121 is designed to occupy exactly 2N distinct stable positions that are evenly spaced apart by angular steps of 45°. The jumper spring 39 is arranged to cooperate with the eight-branch starwheel 149 and its two elements are disposed, one relative to the other, so that one of the magnets 133*a* or 133*b* is always located substantially opposite the magnet 31 of the switching organ 23 when the rotary control organ 121 is in any of its stable positions. In the configuration shown in FIG. 6, the south pole of one of the magnets 133*b* is positioned facing the magnet 31. In these conditions, the magnet 31 of the switching organ 23 is drawn towards the control organ 121 so that the switching organ is immobilised in abutment against the stop 28 and the hook 29 is disengaged from the regulator 17, so that said regulator is thus free to rotate.

The switching device shown in FIG. 6 comprises a push-piece activation mechanism that is practically identical to that of the first example. This mechanism comprises a push-piece 41, a control lever 43 and an intermediate disc 45. However, as shown in FIG. 6, the beak 47 of the control lever 43 is arranged to cooperate directly with the starwheel 149 of the rotary control organ 121. As the starwheel 149 comprises eight branches, it is understood that the effect of pressing the push-piece 41 is to advance the rotary control organ by a step of 45°. Once this step is complete, the north pole of one of the magnets 133*a* will occupy the position opposite the north pole of the magnet 31. In this situation, the magnetic force generated by the interaction between the magnets 31 and 133*a* pushes the magnet 31 so that the rocker 25 pivots and moves away from the stop 28. This pivoting movement causes the hook 29 to be lowered against an external toothing of the regulator 17, which then stops this regulator.

Figure 7:
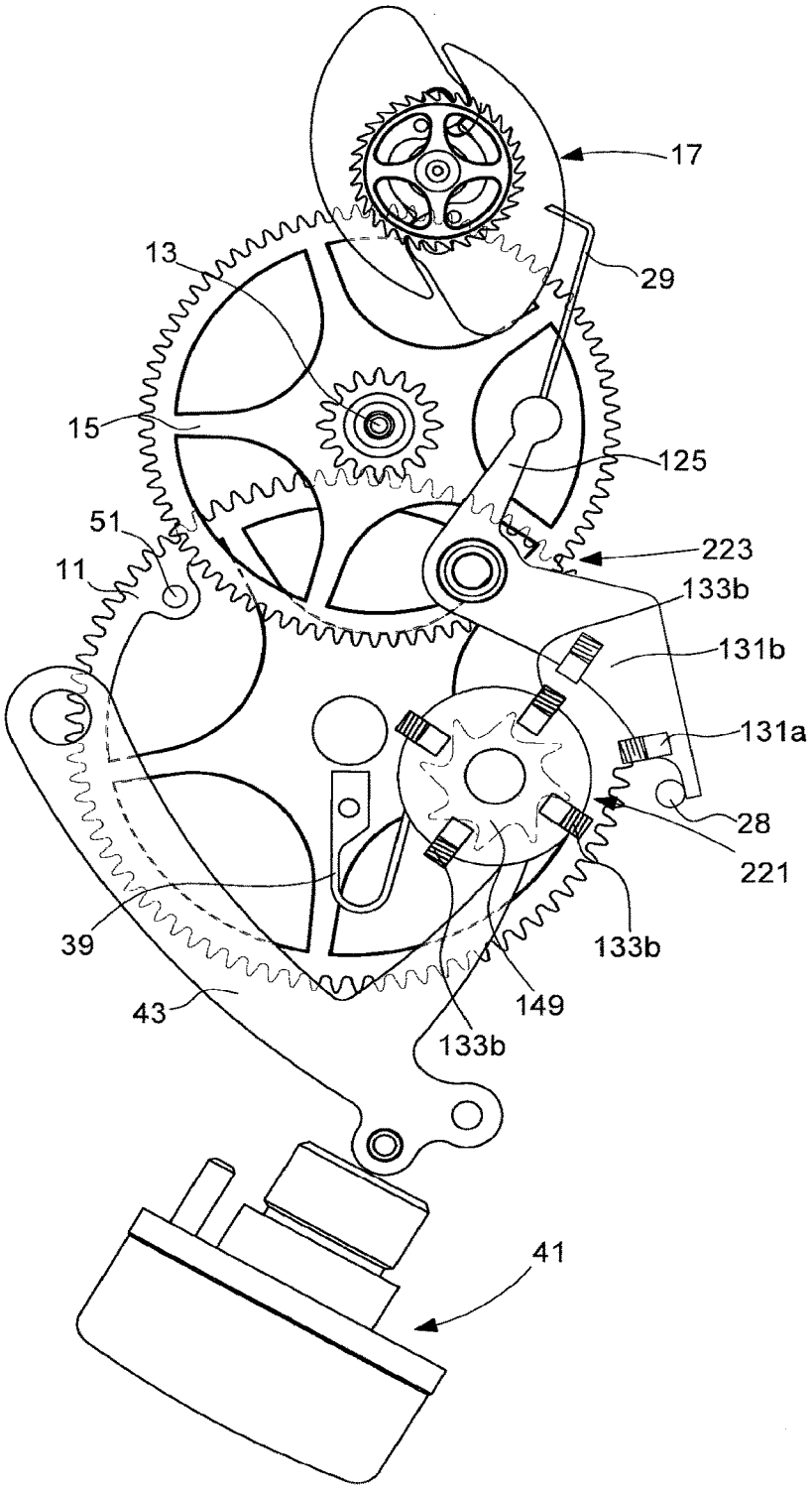
FIG. 7 is a plan top view of a third embodiment of the invention that is made up of a third particular striking-work stop device.

FIG. 7 is a plan top view of a third embodiment of the invention, which, like the first two embodiments, is in the form of a striking-work stop device. This third model of a striking-work stop device shares many features with the second embodiment. For the sake of readability, the elements of the third striking-work stop device that have already been described with reference to the first or the second device are denoted using the same reference numerals in FIG. 7.

Comparing FIG. 7 to FIG. 6 shows that the differences between the second and third examples of a striking-work stop device relate to the two magnetic structures respectively forming the rotary control organ 221 and the movable switching organ 223. Indeed, even though the rotary control organ shown in FIG. 7 comprises a starwheel 149, which comprises eight branches, like in the previous example, the control organ 221 only comprises four bipolar magnets (each referenced 133*b*). The magnetisation direction of all of these magnets is oriented radially with their south pole turned outwards (their north pole being turned towards the axis of rotation). However, the rocker 125 of the movable switching organ 223 supports two bipolar magnets (reference numerals 131*a* and 131*b*). The magnetisation directions of these two magnets are substantially parallel to each other, but in the opposite direction, so that the south pole of the magnet 131*a* and the north pole of the magnet 131*b* are turned towards the control organ 221. It will be noted that the two magnets 131*a* and 131*b* are preferably oriented radially relative to the axis of rotation of the control organ and are angularly offset from the control organ by an angular step.

According to the invention, the rotary control organ 221 is arranged to be stepwise driven in a given direction of rotation in order to successively occupy a plurality of distinct angular positions about its axis of rotation. In this example, it will be understood that the control organ 221 is designed to occupy exactly eight distinct stable positions that are evenly spaced apart by angular steps of 45°. It also will be understood that the eight-branch starwheel 149 and the jumper 39 are disposed relative to one another, so that upon each step only one of the magnets 133*b* is immobilised substantially facing either the south pole of the magnet 131*a* or the north pole of the magnet 131*b*. Still with reference to FIG. 7, it can be seen that in the configuration shown, the south pole of a magnet 133*b* is positioned substantially opposite the north pole of the magnet 131*b*. In these conditions, the magnet 131*b* of the switching organ 223 is drawn towards the control organ 221 so that the switching organ comes into abutment against the stop 28, the movable switching organ then being in a first stable position, in which the hook 29 is disengaged from the regulator 17, so that said regulator is free to rotate.

The switching device shown in FIG. 7 comprises a push-piece activation mechanism, which is identical to that shown in FIG. 6. As the starwheel 149 of FIG. 7 also comprises eight branches, it is understood that the effect of pressing the push-piece 41 is to advance the rotary control organ by a step of 45° in the anti-clockwise direction. Once this step is complete, the magnet 133*b* that was facing the magnet 131*b* is offset therefrom, but another magnet 133*b* is now positioned facing the south pole of the magnet 131*a*. In this situation, the magnetic force generated by the interaction between the magnets 133*b* and 131*a* pushes the arm of the rocker 125 so that said rocker pivots and moves away from the stop 28. This pivoting movement causes the hook 29 to be lowered against an external toothing of the regulator 17, which stops the regulator.

Accompanying FIGS. 8 to 11 show a fourth embodiment of the invention that is made up of a timepiece comprising a rotating bezel and a bezel locking mechanism. It is known that diving watches are generally equipped with a rotating bezel. The main purpose of this bezel is to mark the position of the minute hand at the start of the dive. The diver is then able to know how long he has been under the water at any time by observing the distance covered by the minute hand from the position indexed by the rotating bezel. In order to prevent any accidental modification of the angular position of the rotating bezel during a dive, the rotating bezel is normally equipped with a locking mechanism.

Figure 8:
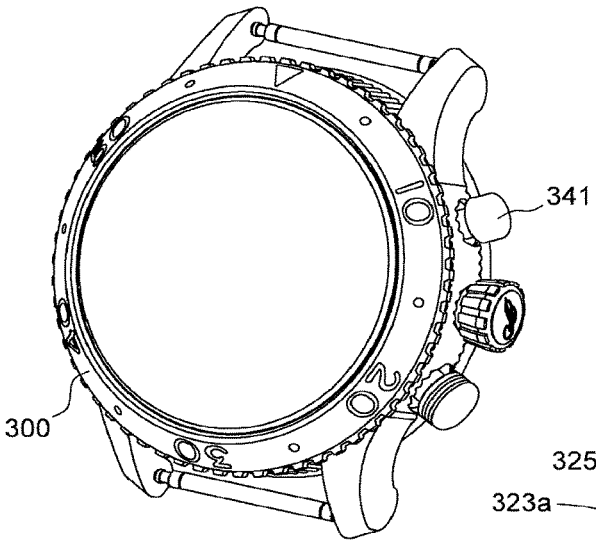
FIG. 8 is a perspective view of a timepiece comprising a rotating bezel and a mechanism for locking the bezel and corresponding to a fourth embodiment of the invention.
Figure 9:
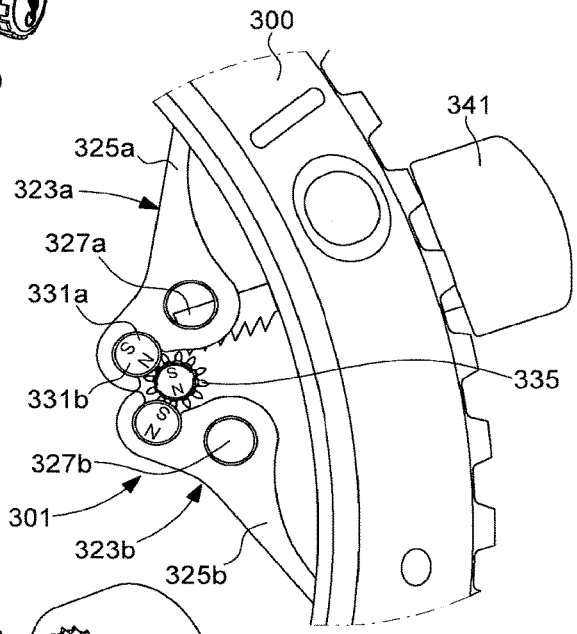
FIG. 9 is a partial plan top view more specifically showing the mechanism for locking the bezel of the timepiece of FIG. 8.

FIG. 8 is a perspective view of a timepiece comprising a rotating bezel (reference numeral 300) and a bezel locking mechanism that is controlled by a pushbutton 341. It will be understood that, according to the invention, the rotating bezel 300 is a timekeeping mechanism that can be in either the locked state or in the unlocked state. Furthermore, the locking mechanism forms an example of a switching device 301 arranged to switch the rotating bezel between a locked state and an unlocked state.

Figure 10:
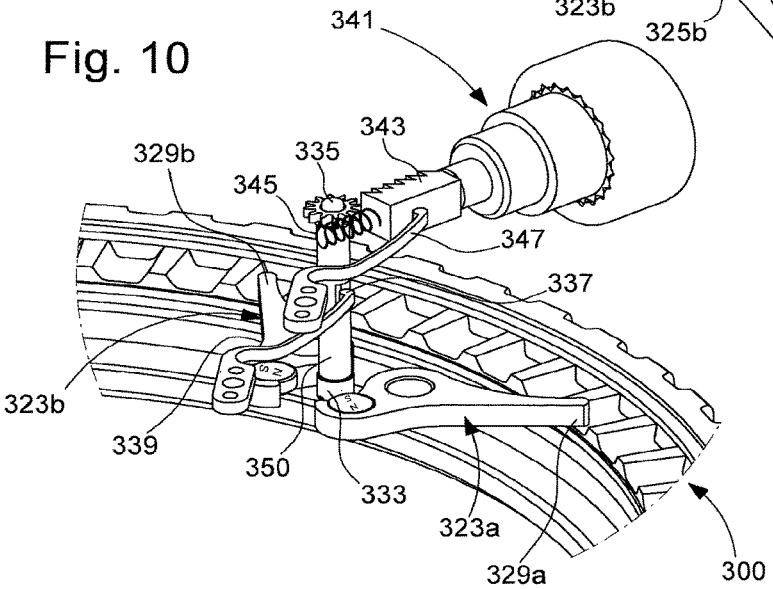
FIG. 10 is a partial perspective view, from the bottom of the timepiece of FIG. 8, showing the rotating bezel and its locking mechanism.

With reference to FIG. 10 in particular, it can be seen that the rotating bezel 300 has a serrated lower face and that the locking mechanism comprises a rotary control organ that is formed by a shaft 350 mounted to pivot about an axis of rotation that is substantially perpendicular to the plane of the bezel 300. The shaft 350 can, for example, be pivoted by its two ends between the watch case (not shown) and a fitting circle (not shown). The shaft 350 is further provided with a coaxial pinion 335 and a bipolar magnet 333. As will be seen in further detail hereafter, the magnetisation direction of the bipolar magnet 333 is perpendicular to the axis of the shaft 350 and the magnet is substantially centred on this axis of rotation. The shaft 350 further comprises a non-cylindrical section that comprises two catches in diametrically opposed positions (a catch is shown in FIG. 10, reference numeral 337). This non-cylindrical section is arranged to cooperate with a jumper spring 339. It fulfils the same role as the bistable cam 37 of the first embodiment.

In the embodiment shown, the switching device further comprises two movable switching organs (reference numerals 323*a* and 323*b*, respectively) that are symmetrically arranged on both sides of the shaft 350. Each movable switching organ comprises a rocker (reference numerals 325*a* and 325*b*, respectively) pivotally mounted about an axis (reference numerals 327*a* and 327*b*, respectively). The rockers each comprise two arms extending from the pivot axis. A first arm is extended by a beak (reference numerals 329*a* and 329*b*, respectively) and the second arm supports a bipolar magnet (reference numerals 331*a* and 331*b*, respectively). The magnetisation direction of the magnets is substantially parallel to the pivoting plane of the rocker. A more detailed examination (FIGS. 11A and 11B) also shows that the magnet 331*a* is oriented with its south pole facing the rotary control organ and that the magnet 331*b* is oriented with its north pole facing the control organ.

As previously mentioned, the switching device 301 shown in FIG. 8 to 11 further comprises a push-piece activation mechanism. This mechanism comprises a push-piece 341, a rack 343 having a toothing with triangular teeth, a coil spring 345 and a jumper spring 347. As shown in the Fig., the rack 343 is returned against the pinion 335 by the jumper spring 347. In these conditions, when the watch wearer presses the push-piece 341, the triangular teeth of the rack 343 cooperate with the toothing of the pinion 335 in order to rotate the rotary control organ. When the watch wearer subsequently releases his pressure on the push-piece, the coil spring 345 pushes the rack 343 towards the push-piece. The triangular shape of the teeth allows the rack to move backwards by sliding on the toothing of the pinion 335 without rotating said pinion. Therefore, it will be understood that, according to the invention, the rotary control organ is arranged to be stepwise driven in a given direction of rotation in order to successively occupy a plurality of distinct angular positions about its axis of rotation. In this example, the control organ is designed to occupy exactly two distinct stable positions, which are spaced apart from each other by an angular step of 180°. Furthermore, the non-cylindrical section of the shaft 350 and the jumper spring 339 are arranged so that the magnetisation direction of the magnet 333 is substantially perpendicular to the axis of symmetry between the two movable switching organs 323*a* and 323*b* when the control organ is in either of its two stable angular positions.

Figure 11A:
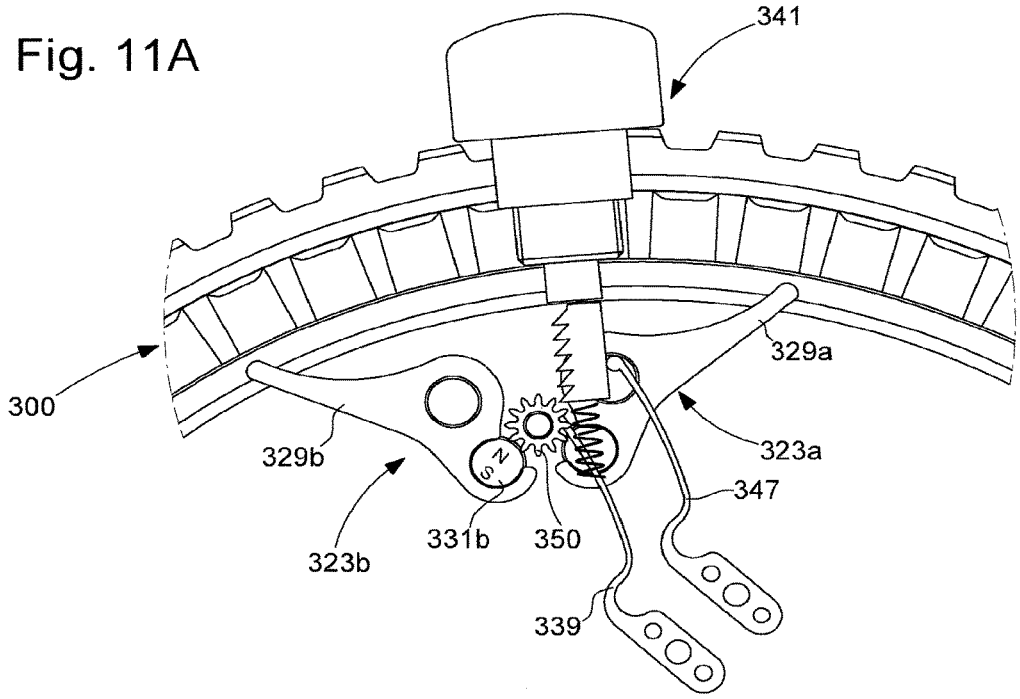
FIG. 11A is a partial plan bottom view showing the mechanism for locking the bezel of the timepiece of FIG. 8 in the disengaged position.
Figure 11B:
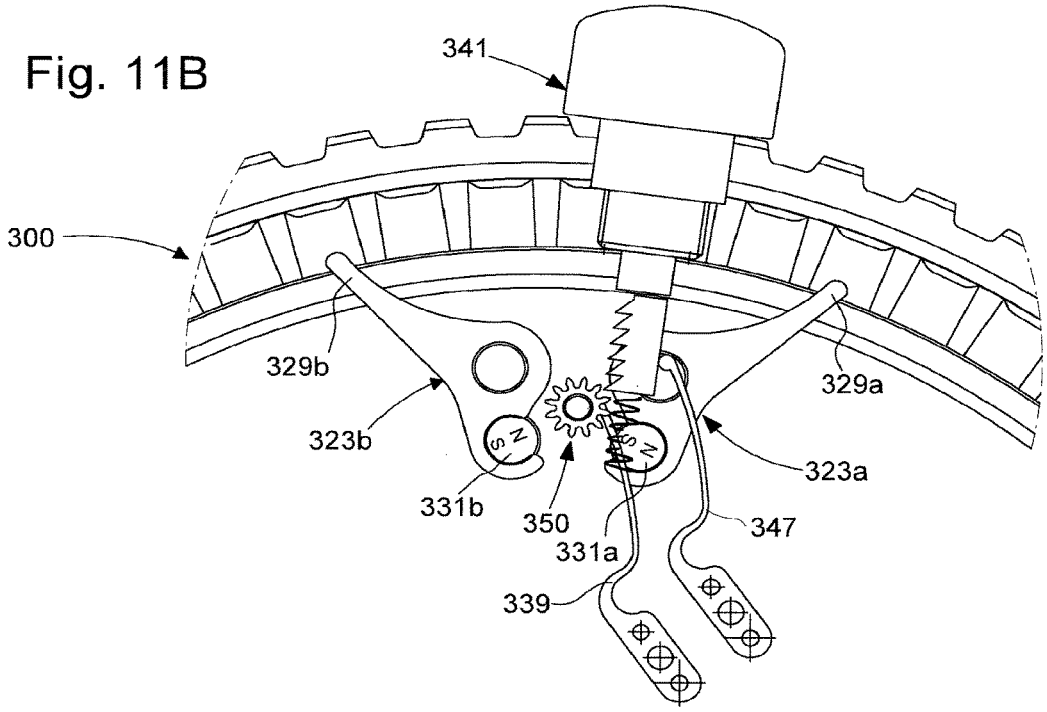
FIG. 11B is a partial plan bottom view showing the rotating bezel of the timepiece of FIG. 8 locked by its locking mechanism.

The operation of the switching device 301 will now be described with reference to FIGS. 11A and 11B in particular. According to the invention, the switching device is arranged so that a stepwise rotation of the rotary control organ causes a reciprocating movement of each of the two movable switching organs 323*a* and 323*b*, substantially in a plane perpendicular to the shaft 350, between two radial positions. In the switching device configuration shown in FIG. 11A, the rotary control organ is turned so that the south pole of the magnet 333 (not shown in the Fig.) is oriented towards a first one 323*b* of the two movable switching organs. In these conditions, the magnet 331*b* of the switching organ 323*b* is drawn towards the shaft 350 of the rotary control organ, so that the switching organ 323*b* is immobilised in a first radial position, in which its beak 329*b* is disengaged from the slots formed on the lower face of the rotating bezel 300. FIG. 11A shows the rotary control organ turned so that the south pole of the magnet 333 (not shown in the Fig.) is oriented towards the movable switching organ 323*b*. The north pole of the magnet 333 is therefore turned towards the other movable switching organ 323*a*. As the magnet 331*a* of the switching organ 323*a* is oriented with its south pole facing the rotary organ, it is thus also drawn towards the shaft 350 of the rotary control organ, so that the second switching organ is immobilised in its first radial position, in which the beak 329*a* is also disengaged from the slots formed on the lower face of the rotating bezel 300. Therefore, the rotating bezel is free to rotate. In these conditions, when a timepiece user activates the push-piece 341, this push-piece pushes the rack 343 so that the triangular teeth thereof set the pinion 335 into rotation. As already shown, the non-cylindrical section of the shaft 350 and the jumper spring 339 are arranged so that the control organ advances in angular steps of 180°. Therefore, the activation of the push-piece 341 by the watch wearer causes the rotary control organ to complete a half-turn, so that the orientation of the magnet 333 inverts, the south pole then being oriented towards the movable switching organ 323*a* and the north pole being oriented towards the switching organ 323*b*. As the magnet 331*a* of the switching organ 323*a* is oriented with its south pole facing the rotary organ, it is pushed by the rotary control organ magnet so that the switching organ 323*a* pivots and is immobilised in a second radial position, in which the beak 329*a* cooperates with one of the slots formed on the lower face of the rotating bezel 300, as shown in FIG. 11B. Furthermore, the magnet 331*b* of the switching organ 323*b* is oriented with its north pole facing the rotary organ; therefore, it is also pushed by the rotary control organ magnet. The switching organ 323*b* therefore also moves to a second radial position, in which the beak 329*b* cooperates with one of the slots formed on the lower face of the rotating bezel 300, as shown in FIG. 11B. The rotating bezel 300 is then locked.

Variants of this fourth embodiment correspond to arrangements with a plurality of bipolar magnets on the control organ or on the switching organ, in a manner similar to the second and third embodiments.

It will be noted that in the various embodiments with control organs comprising at least four magnetic poles interacting with the switching organ, the control organ advantageously can comprise, instead of a plurality of bipolar magnets, a radial multipolar magnet. In a particular variant, the circular or annular shaped radial multipolar magnet comprises 2N external magnetic poles (i.e. oriented towards the outside of this multipolar magnet), N>1, which have alternating polarities (i.e. alternately south and north), with the axis of rotation of the control organ passing through the centre of the multipolar magnet.

It will be noted that further timekeeping applications are provided within the scope of the invention, particularly a lateral clutch device, allowing a torque to be momentarily transmitted, or a device for switching a chronograph mechanism of the type previously described in the section relating to the prior art, in which the column wheel and the one or more associated cam(s) is/are replaced by a switching device according to the invention. Furthermore, it will be noted that the present invention is applicable to embodiments with a plurality of switching organs associated with the same control organ.

In the embodiments that have been described, the control organ is activated by a user via an activation device, such as a push-piece. Further activation devices that are known to persons skilled in the art can be contemplated. These activation mechanisms can be activated by a user or, in further embodiments, can be automatically and particularly periodically activated by the timepiece, i.e. by a further mechanism of this timepiece that cooperates with the mechanism switched according to the invention.

Finally, the invention has been described within the context of fully mechanical timepieces. However, the invention also advantageously can be applied to timepieces with electromechanical parts. Therefore, the device for activating the control organ can comprise an electromechanical motor.

What is claimed is:

1. A timepiece comprising:

a timekeeping mechanism able to switch between a first determined state and a second determined state;

a switching device arranged to switch the timekeeping mechanism between said first state and said second state, this switching device comprising a movable switching organ and a rotary control organ, the rotary control organ being arranged to be stepwise driven in a given direction of rotation in order to successively occupy a plurality of distinct angular positions about an axis of rotation, the switching device being arranged so that a stepwise rotation of the rotary control organ in said direction of rotation causes a reciprocating movement of the movable switching organ substantially in a plane perpendicular to said axis of rotation between two stable radial positions for at least one part of this movable switching organ, said organ being transferred from a first to a second of the two stable radial positions, in order to trigger a first switching of the timekeeping mechanism, when the rotary control organ is placed in a first angular position from among the plurality of distinct angular positions, and the movable switching organ being returned to the first of the two stable radial positions, in order to trigger a second switching of the timekeeping mechanism, when the rotary control organ is placed in a second angular position from among the plurality of distinct angular positions, wherein the movable switching organ and the rotary control organ respectively support a first magnetic structure and a second magnetic structure arranged in order to have a mutual magnetic interaction that allows the timekeeping mechanism to be switched between said first and second states on command, one of the first and second magnetic structures comprising at least one first magnetic pole and the other of the two magnetic structures comprising at least one second magnetic pole and a third magnetic pole with opposite polarities and being able to successively interact with the first magnetic pole, the first and second magnetic structures being arranged so that, in the first angular position of the rotary control organ, a first magnetic force, which is generated by a magnetic interaction between the first and second magnetic poles, acts on the switching organ in order to transfer said organ to the second of said two stable radial positions and so that, in the second angular position of the rotary control organ, a second magnetic force, which is generated by a magnetic interaction between the first and third magnetic poles and is in the opposite direction to the first magnetic force, acts on the switching organ in order to return said organ to the first of said two stable radial positions.

2. The timepiece according to claim 1, wherein said first magnetic pole forms part of said first magnetic structure, whereas said second and third magnetic poles form part of said second magnetic structure.

3. The timepiece according to claim 2, wherein the rotary control organ is arranged to complete steps that each correspond to pivoting by 180°, so that the second magnetic structure is caused to alternately occupy two distinct angular positions about said axis of rotation, said second magnetic structure being formed by a bipolar magnet, the two poles of which form the second and third magnetic poles, said axis of rotation passing between these second and third magnetic poles.

4. The timepiece according to claim 2, wherein the rotary control organ is arranged to complete steps each corresponding to pivoting by an angle $\pi/N$, with $N>1$, so that the second magnetic structure is caused to successively occupy 2N distinct angular positions about said axis of rotation, said second magnetic structure comprising N second magnetic poles and N third magnetic poles radially oriented outwards and evenly distributed about said axis of rotation, the second and third magnetic poles being alternately arranged so that each second magnetic pole is interposed between two third magnetic poles.

5. The timepiece according to claim 4, wherein the second magnetic structure is made up of a radial multipolar magnet comprising 2N alternated external poles, said axis of rotation substantially passing through the centre of the multipolar magnet.

6. The timepiece according to claim 4, wherein the second magnetic structure comprises 2N bipolar magnets radially oriented and evenly distributed about said axis of rotation, the bipolar magnets being alternately magnetically oriented in one direction and in the other direction.

7. The timepiece according to claim 1, wherein the first magnetic structure is made up of a bipolar magnet, one of the two poles of which forms said first magnetic pole.

8. The timepiece according to claim 1, wherein said first magnetic pole forms part of said second magnetic structure belonging to the rotary control organ, whereas said second and third magnetic poles with opposite polarities form part of said first magnetic structure belonging to the movable switching organ.

9. The timepiece according to claim 8, wherein the rotary control organ is arranged to complete steps each corresponding to pivoting by an angle $\pi/N$, with $N>1$, so that the second magnetic structure is caused to successively occupy 2N distinct angular positions about said axis of rotation, wherein said second and third magnetic poles are arranged on the movable switching organ on the periphery of the rotary control organ and, as seen from said axis of rotation of the control organ, they are angularly spaced apart by approximately $\pi/N$, and wherein the second magnetic structure comprises N bipolar magnets radially oriented in the same direction and evenly distributed about said axis of rotation.

10. The timepiece according to claim 8, wherein the first magnetic structure is made up of a pair of bipolar magnets arranged substantially radially relative to said axis of rotation of the control organ and with their polarities inverted.

* * * * *